United States Patent [19]

Olsson

[11] 4,439,134

[45] Mar. 27, 1984

[54] COMBUSTION CHAMBER FOR PULSATING COMBUSTION

[75] Inventor: Karl B. Olsson, Kivik, Sweden

[73] Assignee: Mareck B.V., Amsterdam, Netherlands

[21] Appl. No.: 369,018

[22] PCT Filed: Aug. 12, 1981

[86] PCT No.: PCT/SE81/00228

§ 371 Date: Apr. 8, 1982

§ 102(e) Date: Apr. 8, 1982

[87] PCT Pub. No.: WO82/00702

PCT Pub. Date: Mar. 4, 1982

[30] Foreign Application Priority Data

Aug. 12, 1980 [SE] Sweden ..... 8005680

[51] Int. Cl.[3] ..... F23C 11/04; F23D 13/12

[52] U.S. Cl. ..... 431/1; 431/114; 431/347; 431/348

[58] Field of Search ..... 431/1, 114, 346, 354, 431/347, 348; 60/39.76, 39.82 N, 39.82 E; 222/189

[56] References Cited

U.S. PATENT DOCUMENTS

| | | | |
|---|---|---|---|
| 2,402,971 | 7/1946 | McCollum | 431/114 X |
| 2,460,086 | 1/1949 | Hess | 431/348 X |
| 2,585,221 | 2/1952 | Briskin | 431/347 |
| 2,671,507 | 3/1954 | Morck, Jr. | 431/348 |
| 3,684,424 | 8/1972 | Zink et al. | 431/114 |
| 3,853,453 | 12/1974 | Olsson | 431/1 |
| 4,045,160 | 8/1977 | Michels | 431/348 |
| 4,168,950 | 9/1979 | Seemann et al. | 431/348 |

*Primary Examiner*—Samuel Scott
*Assistant Examiner*—Randall L. Green
*Attorney, Agent, or Firm*—Cushman, Darby & Cushman

[57] ABSTRACT

A combustion chamber for pulsating combustion is separated by a partition wall (12) into a first chamber (14) to which there is connected an axial inlet (20) for the fuel stream, and a second chamber (16) for diverting the combustion gases through an outlet (18). The gases depart via side chambers (44) from the first to the second chamber at the edges of the partition wall. A hot body (24) is arranged at a given height above the partition wall in the first chamber, said body being intended for being heated during operation to a temperature which is substantially higher than the carbonization temperature of the fuel and which screens off a central area of the partition wall.

9 Claims, 9 Drawing Figures

COMBUSTION CHAMBER FOR PULSATING COMBUSTION

The present invention relates to a combustion chamber of the kind having axially aligned first and second chambers, a plurality of side chambers and a partition wall between the first and second chambers for guiding a stream of gases over the edges of the partition wall from the first chamber, through the side chambers and into the second chamber.

BACKGROUND AND SUMMARY OF THE INVENTION

In pulsating burners of the kind in question, there is a fuel nozzle at the inlet to direct the stream of fuel axially into the first chamber in a direction towards a central area of the pertinent partition wall in the combustion chamber. In the case where a liquid fuel such as oil is used, vaporization is already obtained in the inlet, but a portion of the fuel will impinge on the partition wall in the form of vapour or fuel drops. For all conditions, some cooling of the partition wall is obtained, and this cooling can be so heavy in some cases that the fuel carbonizes, to be deposited as soot, which results in operational disturbances, especially when starting.

The object of the invention is to avoid this problem, and this is achieved in accordance with the invention. The hot body in accordance with the invention spreads out the fuel while coming up to a temperature high enough to be substantially above the carbonization temperature of the fuel by a large margin. The desired intense heating of the hot body is done with the aid of the hot gases in the first chamber in the combustion chamber, and by heat transmission from the partition wall to the hot body via the foot of the latter.

The hot body in accordance with the invention spreads the fuel and screens off the central area of the partition wall, which thus cannot be struck by cooling fuel. The hot body simultaneously contributes, as is known in the art, to stabilizing the combustion in the combustion chamber.

To further increase heating of the hot body, its foot can to advantage be formed as a pillar extending through an opening in the partition wall to be situated in the hot gases in the outlet.

BRIEF DESCRIPTION OF THE DRAWINGS

Two suitable embodiments of the invention are shown as examples on the appended drawings.

DETAILED DESCRIPTION

Figure 1:
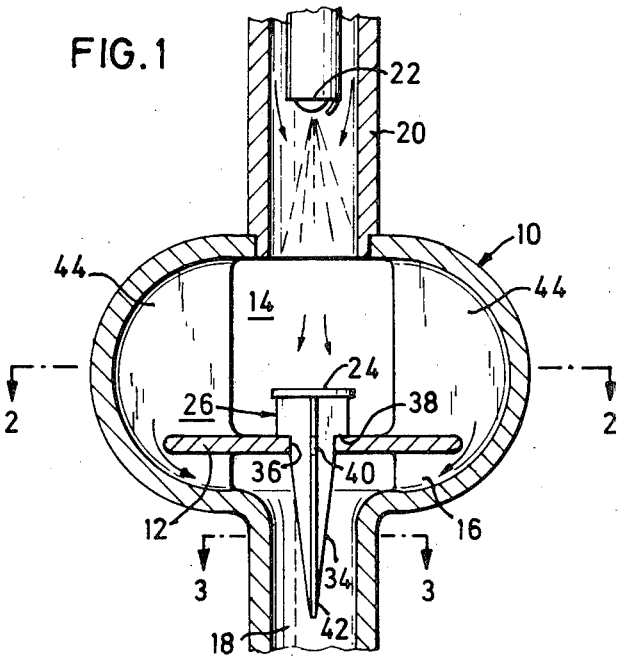
FIG. 1 is a schematic section through a combustion chamber for pulsating combustion, the partition wall in the combustion chamber supporting a disc-shaped hot body in accordance with the invention.

The combustion chamber 10 in FIG. 1 is of known form and is divided by a partition wall 12 into a first chamber 14 and a second chamber 16, the latter merging into an outlet 18. Combustion air is inducted via an inlet 20, in which a nozzle 22 is arranged for spraying in fuel such as oil for admixture with the combustion air. It will be seen from FIG. 1 that the spread angle of the nozzle is comparatively small, resulting in that the fuel is directed in a relatively concentrated jet into the first chamber 14.

To avoid fuel particles impinging on the partition wall 12 in its central area, and thereby cooling this area to an undesirably low temperature which can cause the formation of soot, a flat-shaped hot body 24 is arranged at a predetermined height above the partition wall. In the example shown, the hot body 24 is substantially circular, to give a uniform spread to the fuel irrespective of the width of the fuel jet.

The body 24 is carried by a foot or a support 26 in the form of four radial flanges 25,28,30,32 arranged in a cross.

The foot 26 has an upper part situated above the wall 12, and an extension portion 34 extending through a central hole 36 in the wall 12, down into the second chamber 16 and further down into the outlet 18.

Each flange has a shoulder 38 resting on the wall 12. After this shoulder, the width of the flanges is constant along a portion 40 for location in the hole 36 of the wall 12. Below the partition wall 12, the flanges taper off in a direction towards an end portion 42.

The fuel-air mixture and hot gases stream out conventionally from the central portion of the first chamber into a number of side chambers 44, over the edges of the partition wall 12 into its side chambers, down into the second chamber 16 and out through the outlet 18.

During operation, the hot body 24 is kept heated to a high temperature which is sufficient for the body 24 always to have a temperature substantially greater than the carbonization temperature of the fuel. The central area of the wall 12 will therefore lie in a protected position under the shielding hot body 24, so that the central area of the wall 12 will also retain a temperature which is so high that it is substantially above the carbonization temperature of the fuel.

The body 24 is heated by the hot gases in the first chamber. Furthermore, the extended portion 34 of the foot or support 26 will be heated by the hot gases in the second chamber and in the outlet. The heat spreads upwards in the foot and results in there being supplementary heat to keep the body 24 hot. Heat is also transmitted from the wall 12 to the foot 26 and further to the body 24. With its foot 26 the body 24 is loosely inserted in the hope 36 in the wall 12 and therefore it can be easily lifted out and up through the inlet 20 for possible exchange. It is thus extremely easy to fit or remove the body 24.

The embodiment according to FIGS. 4 to 9, which has been developed further, has a substantially spherical hot body 50 carried by a short neck 51 with a flange 52 having slots **52*a*, said flange abutting the upper side of the wall 12**.

Below the flange 52, the neck is extended by a pillar 53 which is located in the hole 36 in the wall 12 in the same way as the portion 34 is located in the hole 36 in FIG. 1.

The pillar 53 extends through the second chamber 16 and down into the outlet 18 to be heated by the exhaust gases.

The hot body 50 is formed at its upper end with a recess having a diameter of the same order of magnitude as the radius of the body 50. The depth of the recess is approximately the same as its radius.

Around its spherical surface, the body 50 has a number of uniformly distributed slits 55,56, the alternate slits 56 being in communication with the bowl-shaped recess 54 via radially transverse grooves 57.

Figure 2:
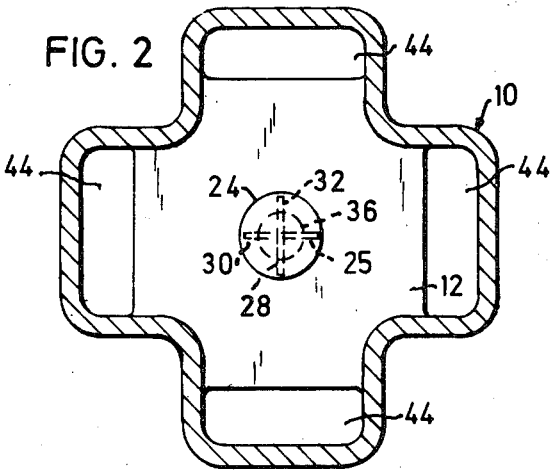
FIG. 2 is a cross section along the line 2—2 in FIG. 1.
Figure 3:
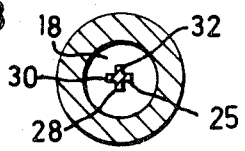
FIG. 3 is a cross section along the line 3—3 in FIG. 1.

For predetermined and comparatively constant operating conditions, the flat-shaped hot body 24 according to FIGS. 1 to 3 functions completely satisfactory for providing a reliable start and stable operation, and for avoiding soot formation in the first chamber on the partition wall 12.

Figure 4:
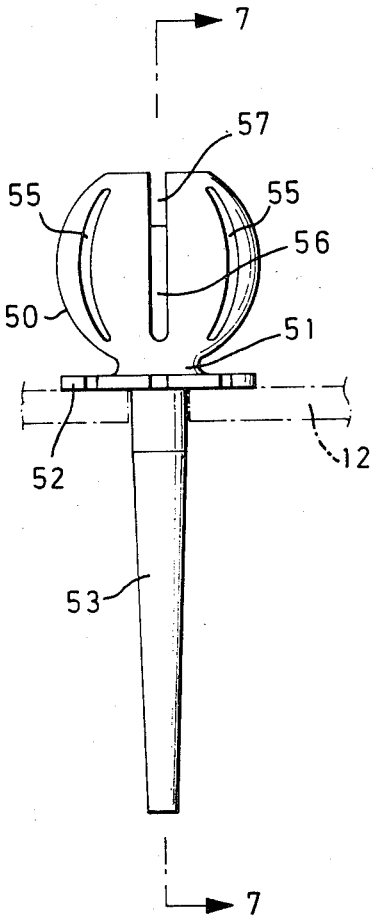
FIG. 4 is a side view of the second embodiment, comprising a spherically shaped hot body with a pillar mounted in the opening in the partition wall according to FIG. 1.
Figure 5:
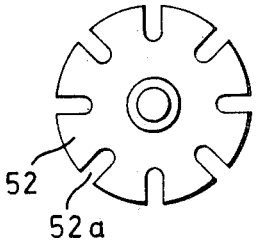
FIG. 5 is a view seen from below of the hot body in FIG. 4.
Figure 6:
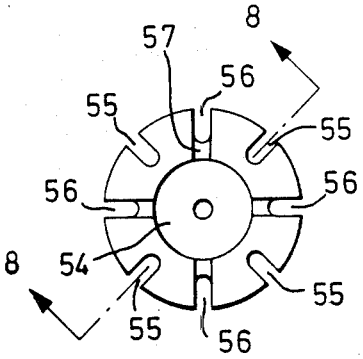
FIG. 6 is a view from above.
Figure 7:
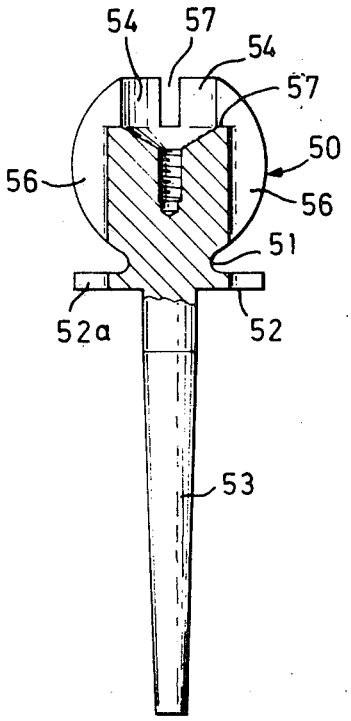
FIG. 7 is a section along the line 7—7 in FIG. 4.
Figure 8:
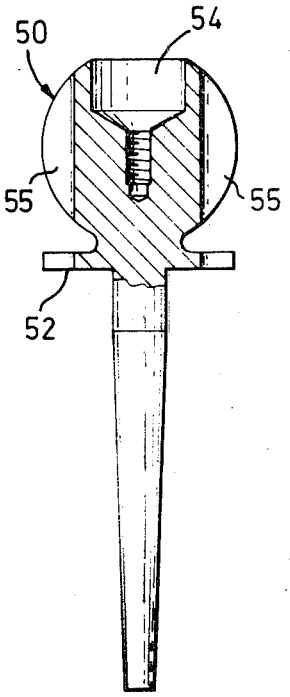
FIG. 8 is a section along the line 8—8 in FIG. 6.
Figure 9:
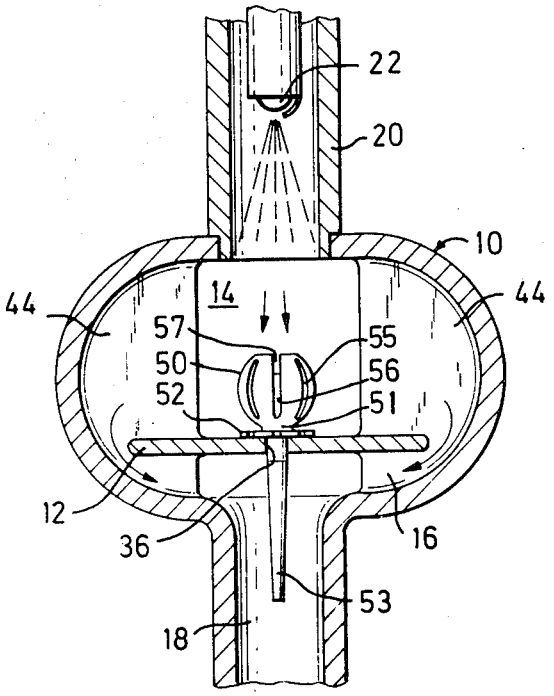
FIG. 9 shows the spherical hot body mounted in the combustion chamber.

On the other hand, if the operating conditions vary, inter alia with different types of fuels and varying loads, the spherically shaped hot body 50 in FIG. 4 affords greater flexibility and security.

I claim:

1. A combustion chamber for pulsating combustion of a fuel-air mixture, the combustion chamber having a first chamber, a second chamber and a plurality of side chambers and including an inlet and an outlet having a common axis and providing substantially axial inflow of the fuel-air mixture to the first chamber and substantially axial outflow for the second chamber, as well as a partition wall situated substantially in a radial plane relative to said axis and separating the inlet and outlet chambers to guide the stream of gases over the edges of the partition wall from the first chamber via the plurality of side chambers to the second chamber, characterized in that an elongated member extends axially through a central opening in the partition wall and through the second chamber and into the outlet so as to be heated by the gases, the member having an end disposed between said partition wall and the inlet, said end having associated therewith a hot body located in the first chamber to serve as a hot fuel spreader.

2. A combustion chamber as claimed in claim 1, characterized in that the hot body has a concave striking surface facing towards the inlet for the fuel drops.

3. A combustion chamber as claimed in claim 1, characterized in that the hot body is substantially spherically shaped.

4. A combustion chamber as claimed in claim 3, characterized in that the upper end of the spherically shaped hot body is provided with at least one recess for the reception of fuel drops.

5. A combustion chamber as claimed in claim 4, characterized in that the diameter of the recess is of the same order of magnitude as the radius of the spherical body, and in that the depth of the recess is approximately equal to its radius.

6. A combustion chamber as claimed in claim 4 or 5, characterized in that a plurality of uniformly distributed, axial slits are made in the spherical surface of the body.

7. A combustion chamber as claimed in claim 6, characterized in that at least some of the slits communicate with the recess via radial grooves.

8. In a combustion chamber for pulsating combustion of a fuel-air mixture of the type including an inlet and an outlet having a common axis, a first chamber in communication with said inlet and of larger cross-section than said inlet, a second chamber in communication with said outlet and of larger cross-section than said inlet, a plurality of side chambers, and a partition wall lying in substantially a radial plane relative to said axis and separating said first and second chambers, said partition wall having edges over which gases flow from said first chamber through said side chambers into said second chamber, the improvement comprising means for preventing impingement of fuel particles on said partition wall and adapted to be heated by hot gases, said means including a fuel-spreader portion disposed in said first chamber between said inlet and said partition wall for absorbing heat from said first chamber to be heated to a temperature greater than the carbonization temperature of the fuel and a foot portion extending from said fuel-spreader portion through said second chamber and into said outlet for absorbing heat from said second chamber and for transmitting such heat to said fuel-spreader portion.

9. A combustion chamber as in claim 8 wherein said means is an elongated member extending through a central opening in said partition wall and removably supported by said partition wall.

* * * * *